United States Patent [19]

Roberts

[11] 4,106,385

[45] Aug. 15, 1978

[54] DIGITAL ARPEGGIO GENERATING DEVICE

[75] Inventor: Patrick S. Roberts, Glendale Heights, Ill.

[73] Assignee: Thomas International Corporation, Chicago, Ill.

[21] Appl. No.: 619,810

[22] Filed: Oct. 6, 1975

[51] Int. Cl.[2] ..... G10H 3/06; G10F 1/00; G10H 1/02

[52] U.S. Cl. ..... 84/1.24; 84/1.01; 84/1.03; 84/1.17; 84/DIG. 2; 84/DIG. 22

[58] Field of Search ..... 84/1.01, 1.03, 1.17, 84/1.24, DIG. 2, DIG. 12, DIG. 22

[56] References Cited

U.S. PATENT DOCUMENTS

| | | | |
|---|---|---|---|
| 3,358,070 | 12/1967 | Young | 84/1.17 |
| 3,548,066 | 12/1970 | Freeman | 84/1.03 |
| 3,617,602 | 11/1971 | Kniepkamp | 84/1.17 |
| 3,651,729 | 3/1972 | Adachi | 84/1.17 |
| 3,718,748 | 2/1973 | Bunger | 84/1.24 |
| 3,725,562 | 4/1973 | Munch et al. | 84/1.24 |
| 3,832,479 | 2/1973 | Aliprandi | 84/1.03 |
| 3,842,184 | 10/1974 | Kniepkamp et al. | 84/1.01 |

*Primary Examiner*—Edith S. Jackmon
*Attorney, Agent, or Firm*—Wegner, Stellman, McCord, Wiles & Wood

[57] ABSTRACT

An arpeggio circuit for an electronic organ employing digital encoding, decoding and code conversion techniques to semiautomatically generate an arpeggio effect composed of tone signals having an octaval relationship and corresponding to selected note keys held down on an accompaniment keyboard. The rate of generation and order of the arpeggio tone signals is controlled by means of a plurality of manually actuatable arpeggio control switches. A plurality of individually identifiable control signals are sequentially generated in response to sequential actuation of the plurality of control switches. The control signals are binarily encoded. Tone signals provided by a set of tone generators are selectively associated with appropriate ones of the encoded control signals by a tone selector circuit which provides the selected one of the tone signals to an arpeggio output tone signal generating circuit when the associated encoded control signal is being generated. An octave select circuit of the output circuit selectively generates an output tone signal at a selected octavely related frequency to the selected tone signal in response to the encoded control signal associated therewith. Both the tone selector and the octave selector are responsive to make tone selections for a given control signal depending upon the number of selected notes. The encoding of the control signals is accomplished by a single decoder which develops decode control signals for controlling both the tone selection and octave selection. The decoder is alternately employed by both an automatic arpeggio and the manual arpeggio circuit. When used by the manual arpeggio circuit, a code converter alters the input codes to the decoder so that an output arpeggio tone signal is generated in response to actuation of each of the control switches.

20 Claims, 11 Drawing Figures

40
S1
S2
S3
S4
S5
S6
S7
S8
S9
S10
S11
S12
S13
S14
S15
42
V
58
56
P1
43
C1
44
62
60
P2
C2
66
P3
64
C3
72
70
68
C4
P4
C5
P5
P6
C6
P7
C7
P8
C8
P9
C9
P10
C10
P11
C11
P12
C12
P13
C13
P14
C14
P15
C15
65
46
57
BD
59
BE
61
BF
63
BG

V+
48
BD
BE
BF
BG
SET
D Q
CLK
CLR
67
69
71
73
IE-4
IE-5
74
76
90
92
94
96
84
82
86
75
77
79
81
100
102
104
106
D̄
Ē
F̄
Ḡ
D'
E'
F'
G'
136
138
140
142
50
52
54
ALT. CODE GENERATION CKT
116
118
120
122
124
108
110
112
114
126
128
134

4 NOTES
3 NOTES
2 NOTES
1 NOTE
4 NOTES
3 NOTES
2 NOTES
4 NOTES
3 NOTES
4 NOTES
TS1
TS2
TS3
TS4
ST
NOTE INFO FROM 22
SELECTED TONE GENERATOR 26
T4
T3
T2
T1
T
Q
330
236
232

Fig. 9.

| | | TONE | | | |
|---|---|---|---|---|---|
| SWITCH | OCTAVE | 4 NOTES | 3 NOTES | 2 NOTES | 1 NOTE |
| S1 | OS2 | TS1 | TS1 | TS1 | TS1 |
| S2 | OS2 | TS2 | TS2 | TS1 | TS1 |
| S3 | OS2 | TS3 | TS2 | TS2 | TS1 |
| S4 | OS2 | TS4 | TS3 | TS2 | TS1 |
| S5 | OS3 | TS1 | TS1 | TS1 | TS1 |
| S6 | OS3 | TS2 | TS2 | TS1 | TS1 |
| S7 | OS3 | TS3 | TS2 | TS2 | TS1 |
| S8 | OS3 | TS4 | TS3 | TS2 | TS1 |
| S9 | OS4 | TS1 | TS1 | TS1 | TS1 |
| S10 | OS4 | TS2 | TS2 | TS1 | TS1 |
| S11 | OS4 | TS3 | TS2 | TS2 | TS1 |
| S12 | OS4 | TS4 | TS3 | TS2 | TS1 |
| S13 | OS5 | TS1 | TS1 | TS1 | TS1 |
| S14 | OS5 | TS2 | TS2 | TS1 | TS1 |
| S15 | OS5 | TS3 | TS2 | TS2 | TS1 |

TS1 - LOWEST NOTE
TS2 - SECOND LOWEST NOTE
TS3 - THIRD LOWEST NOTE
TS4 - FOURTH LOWEST NOTE

DIGITAL ARPEGGIO GENERATING DEVICE

BACKGROUND OF THE INVENTION

This invention relates to an electrical musical instrument for semiautomatically producing a series of frequency-related tone signals, such as an arpeggio, and, more particularly, to such an instrument in which production of the related tones is manually controllable through sequential actuation of a set of control switches.

An arpeggio is manually accomplished by a skilled organist by sequentially depressing selected note keys of one octave of the keyboard, followed by the sequential depression of the corresponding keys for the same notes in the next higher octave and so on through the several octaves of the keyboard. This requires the dexterity that is often found lacking except in skilled organists. Accordingly, circuits have been produced for automatically developing an arpeggio effect in which the operator need only depress the keys for the selected notes in one octave and then actuate an arpeggio switch. These circuits, by sequentially enabling logic gates or the like, automatically cause generation of a sequence of arpeggio-related tone signals corresponding to the selected notes. Examples of this type of circuit are shown in U.S. Pat. No. 3,617,602 of Kniepkamp and in the U.S. application of Roman A. Adams, Ser. No. 418,577, filed Nov. 23, 1973, for "Electrical Musical Instrument With Automatic Sequential Tone Generation" now U.S. Pat. No. 3,954,038 assigned to the assignee of the present application. Examples of other automatic arpeggio effect circuits are found in U.S. Pat. Nos. 3,842,184 of Kniepkamp, 3,725,562 of Munch, Jr., et al., 3,718,748 of Bunger, and 3,832,479 of Aliprandi.

While such circuits have effectively enabled unskilled organists to produce an arpeggio effect, the almost complete automatic nature of the tone generation has prevented maximum user satisfaction. Once the notes for the arpeggio have been selected and the arpeggio switch actuated, the circuit takes control. Accordingly, the organist loses a feel of participation in the production of the music.

A proposed solution to this problem is found in the circuit shown in U.S. Pat. No. 3,358,070 of Young. A semi-automatic arpeggio effect circuit is shown in this patent in which keyer circuits are controlled by a set of arpeggio keyboard switches and conventional keyboard switches in such a manner that only when both the arpeggio keyboard switch and a corresponding conventional keyboard switch are closed will a corresponding tone signal be produced. An arpeggio keyboard switch is provided for each selectable note of the several octaves through which the arpeggio is to be developed. Likewise, each arpeggio keyboard switch is connected with the keyer of a tone generator corresponding to its associated note. Selection of a note on the conventional keyboard enables all of the corresponding arpeggio keyboard switches. Actuation of an enabled arpeggio keyboard switch results in generation of the tone signal of the keyer connected therewith. However, note tones are not generated in response to actuation of an arpeggio keyboard switch which has not been enabled.

A semiautomatic arpeggio circuit similar to that of Young is shown in U.S. Pat. No. 3,651,729 of Adachi. There, tone signals are generated through control of a variable frequency oscillator 2. When an operator's finger slides along a resistive rod 8 thereby sequentially engaging it with a plurality of contacts 9, an arpeggio effect is created. The frequency of the oscillator is appropriately changed whenever contact is made with one of the contacts 9 associated with an actuated keyboard switch K1 through K20. As in the circuit of Young, closure of one of the arpeggio control switch contacts 9 results in generation of an appropriate tone only if that switch contact has been enabled through actuation of one of the conventional keyboard switches K1 through K20 associated therewith.

The semiautomatic circuits of Young and Adachi thus overcome the principal disadvantage of the completely automatic arpeggio effect. The aforementioned completely automatic circuits do, however, produce a more perfect arpeggio sequence in which the time period between generation of successive notes is substantially constant and of very short duration. The Young and Adachi circuits produce an arpeggio sequence in which the time periods between immediately successive tone signals vary in accordance with the location of those tone signals on the musical scale, for tone signals are only generated in response to actuation of the arpeggio control switches that are enabled, and no tone signals are produced in response to actuation of the intermediate arpeggio control switches that have not been enabled. For like reasons, the time duration between generation of the last tone signal in one octave and the first tone signal in the next higher octave is dependent upon the note selection, and is variable. In addition, the Young and Adachi circuits require a large number of electrical connections and are, therefore, costly and likely to be subject to failure.

SUMMARY OF THE INVENTION

The semiautomatic arpeggio effect circuit of the present invention overcomes the disadvantages of prior arpeggio effect circuits noted above. The advantages of both the semiautomatic and the automatic arpeggio effect circuits discussed above are obtained while the respective disadvantages thereof are overcome.

The generation of the arpeggio tone signals is controllable through manual actuation of a set of arpeggio control switches which are mounted on the keyslip between the solo and accompaniment keyboards. However, unlike the prior semiautomatic arpeggio effect circuits, in the present digital arpeggio circuit successive tone signals of the arpeggio sequence are generated in response to sequential actuation of immediately successive control switches regardless of the note selection and regardless of the number of notes selected. Actuation of each and every switch between the switch corresponding to the first tone signal of the sequence to the switch corresponding to the last tone signal of the sequence results in generation of an appropriate tone signal.

In an illustrative embodiment of the invention, the circuit is used in a musical instrument such as an electrical organ having a conventional keyboard or the like for selecting notes from a plurality of selectable notes and means for simultaneously providing tone signals corresponding to the selected notes. The circuit includes control means, such as a set of arpeggio control switches, manually actuatable for successively generating a plurality of individually identifiable control signals less than the plurality of selectable notes, i.e., less than the total number of notes of the several octaves through which the arpeggio is played. Thus if the arpeggio is played in all octaves of the lower keyboard which usually comprises 36 keys, the number of switches may be 15. A tone selection circuit associates each of the tone signals with at least one of the control signals. Means including an octave selection circuit is responsive to generation of each control signal having an associated tone signal for generating an output tone signal with a predetermined frequency relationship therewith.

An important feature of the digital arpeggio circuit is that the tone selection circuit and the octave selection circuit are responsive to both the control signals and the number of selected notes. The arpeggio tone signal generated in response to a given control signal varies in accordance with the number of selected notes. Actuation of each arpeggio control switch results in generation of a corresponding tone signal, but, depending upon the number of selected notes, the same tone signal is sometimes generated in response to actuation of more than one arpeggio control switch. Another important feature is that the semiautomatic arpeggio circuit can operate on the tone signals which are stored in a memory circuit, thereby freeing one of the organist's hands for further playing.

A further important feature of the present invention is the use of a single decoder by both a completely automatic arpeggio circuit and the present semiautomatic digital arpeggio circuit. This is achieved through the use of a code converter in conjunction with the semiautomatic arpeggio circuit.

Other features and advantages of the invention will be apparent from the following description and from the drawings. While illustrative embodiments of the invention are shown in the drawings and will be described in detail herein, the invention is susceptible of embodiment in many different forms, and it should be understood that the present disclosure is to be considered as an exemplification of the principles of the invention, and is not intended to limit the invention to the embodiments illustrated.

BRIEF DESCRIPTION OF THE DRAWINGS

FIG. 9 is an input/output chart representative of the relationship between the manual input to the arpeggio code generator and the output of the arpeggio gating circuit of FIG. 1 developed when the code converter of FIG. 4 is employed.

DESCRIPTION OF THE PREFERRED EMBODIMENT

Figure 1:
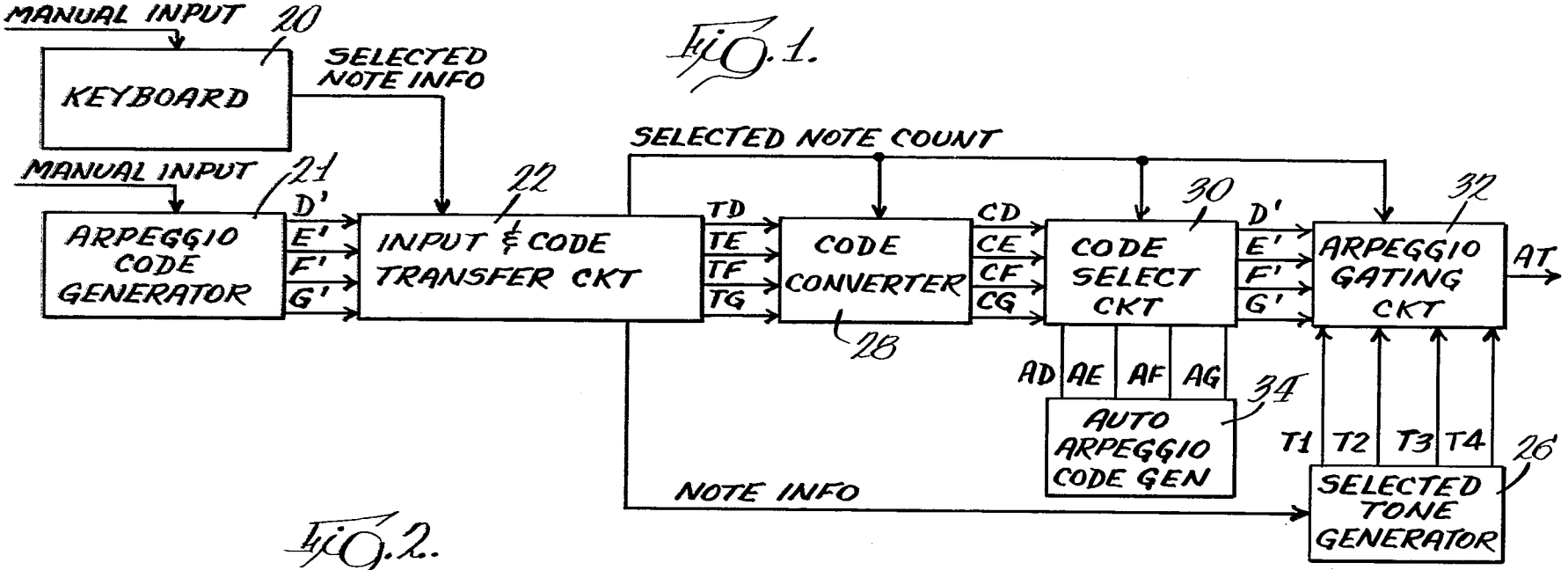
FIG. 1 is a simplified functional block diagram of the digital arpeggio circuit as employed in an electrical musical instrument having an accompaniment keyboard, an input circuit and means for providing tone signals corresponding to notes selected on the keyboard.

Referring to FIG. 1, the arpeggio circuit is employed in conjunction with an electrical musical instrument having a keyboard 20 composed of a plurality of keys and associated key switches respectively corresponding to the plurality of notes of a musical scale. The selected note information represented by the actuated key switches is transferred to an input and code transfer circuit 22. Circuit 22 digitally encodes the selected note information and transfers it to a selected tone generator 26.

The selected tone generator selectively generates four tone signals on outputs T1 through T4 thereof respectively corresponding to the lowest four selected notes. The tone signals corresponding to the selected notes are respectively provided on said outputs T1 through T4 in ascending order of frequency, the tone signal corresponding to the lowest selected note on a musical scale being provided on output T1, the tone signal corresponding to the second lowest selected note being provided on T2, and so on. For purposes of brevity, the tone signals on outputs T1 through T4 will hereinafter be referred to as tone signals T1 through T4, respectively.

The input and code transfer circuit 22 also receives 4-bit binary arpeggio codes on outputs D', E', F' and G', with the least significant bit appearing on output D'. These codes are generated in response to actuation of associated arpeggio control switches of the arpeggio code generator 21 which will be described hereinafter with reference to FIG. 3*a*. These codes are transferred to circuit 22 which develops the four bits of the arpeggio code on outputs D, E, F and G into the code on outputs TD, TE, TF and TG, respectively. The code input and transfer circuit 22 also includes means for detecting the number of selected notes and provides an indication thereof to a code converter 28, a code select circuit 30 and an arpeggio gating circuit 32.

The present invention is not concerned with the precise manner in which the arpeggio code generator output codes are transferred to the code converter 28 nor the precise manner in which the selected note information is generated through manual input to the keyboard and transferred to the selected tone generator. Further, the precise manner and circuitry by which the selected tone generator 26 generates the four selected tones nor the precise manner in which the code input and transfer circuit 22 detects the number of selected notes are not the subject of the present invention. Accordingly, for the sake of brevity, the details with regard to these circuits will not be described herein.

Numerous keydown detectors, code transfer circuits and tone selection circuits and keyboard switch circuits are known which are capable of satisfactorily performing the requisite function of the code input and transfer circuit 22, the selected tone generator 26, and keyboard 20 as described above. However, particular circuits suitable for performing the respective functions of these circuit blocks are described in detail in the co-pending application of Howard B. Kaplan entitled, "Tone Selector Circuit With Multiplexed Tone Data Transfer", Ser. No. 603,860 filed Aug. 11, 1975, and my co-pending application Ser. No. 603,859 filed Aug. 11, 1975, entitled, "Note Selector Circuit for Electronic Musical Instrument", both of which are assigned to the assignee of the present invention. Those applications describe structure wherein both keyboard and function information corresponding to the arpeggio code information are transferred through a common input circuit to an encoding logic circuit on a time division multiplex basis. From the encoding logic circuit, the note information is transferred to note latches, and in response to the stored note codes, a tone selector and tone demultiplex circuit provide a plurality of tone signals corresponding to the selected note code. Likewise, the encoding logic circuit transfers the function code such as codes D, E, F and G, to a corresponding number of function latches. The information stored in the function latches is then utilized by other circuits to perform special functions on the selected tone signals such as, for instance, an automatic arpeggio function. Further information may be obtained by reference to the specifications of either of these two applications which are hereby incorporated herein.

The arpeggio gating circuit generates the arpeggio output tone signals at frequencies octavely related with associated ones of the selected tone signals T1 through T4 in accordance with the selected codes on outputs D', E', F' and G' of code select circuit 30 and the selected note count information from code input and transfer circuit 22.

The code select circuit 30 selectively provides code signals on its outputs D' through G' corresponding to the codes on outputs AD, AE, AF and AG, respectively, of an auto arpeggio code generator circuit 34 or corresponding to the codes on outputs CD, CE, CF, and CG, respectively, of code converter 28. The output arpeggio tone signal is generated in response to the manual arpeggio code generator circuit 21. A tone signal is generated in response to actuation of each of the arpeggio control switches. This is accomplished by the use of code converter 28. It should be understood that a code converter 28 need not be employed to practice the invention and that the code provided to the arpeggio gating circuit can be taken directly from the code input and transfer circuit 22. If these codes are selected, the generation of the output arpeggio tone signals is also controlled by the manual arpeggio code generator 21, but tone signals are generated only in response to actuation of the first number of control switches corresponding to the number of arpeggio tone signals in the complete sequence. By way of example assume that two keys are depressed, thus indicating selection of two notes. Also assume that four octaves span the range of the keyboard. In the described semiautomatic mode the arpeggio would contain as many notes as there are arpeggio switches, which in the embodiment shown number 15, thus some of the notes would be repeated. In the alternate mode only eight notes would be sounded; namely, two for each octave. Thus no notes would be sounded in response to depression of the last 8 arpeggio switches. FIG. 9 presents a graphic illustration of preferred mode results, as will be explained in detail later.

When the codes provided on outputs D' through G' are selected from the auto arpeggio code generator 34, the arpeggio tone signals are automatically generated without interaction with code generator 21 as the codes on outputs Q1 through Q4 are automatically generated. The details of operation of the auto arpeggio code generator per se do not form a part of this invention. Functionally, the auto arpeggio code generator successively generates the binary counts of 0 through 15 and is controlled to stop at a given count for a predetermined time upon detection of a note code corresponding thereto. During the period that this count or code is held, the arpeggio gating circuit in response thereto generates an associated arpeggio output tone signal. The details of operation for such an auto arpeggio code generator functioning as described above can be obtained by reference to the co-pending application of Roman A. Adams, Ser. No. 418,577, filed Nov. 23, 1973, entitled, "Electrical Musical Instrument with Automatic Sequential Tone Generation", assigned to the assignee of the present invention.

Figure 2:
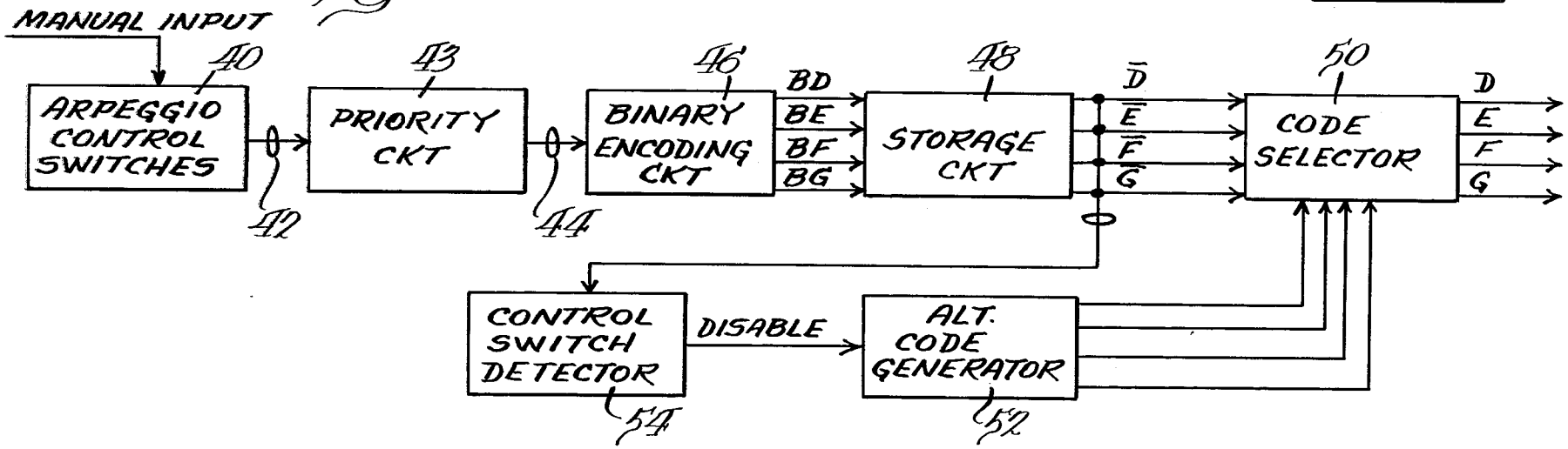
FIG. 2 is a more detailed functional block diagram illustrating the arpeggio code generator block of FIG. 1.

Referring to FIG. 2 which shows arpeggio code generator 21 in detail the manual input to the arpeggio code generator is achieved through a set of arpeggio control switches 40. In response to actuation of each one of the control switches, a control signal is generated on an associated one of a plurality of outputs 42. These control signals are coupled to a priority circuit 43 which establishes an order of priority for the control switches 40. Priority circuit 43 has a plurality of outputs 44 respectively associated with the plurality of arpeggio control switch outputs 42. When more than one arpeggio control switch is actuated at a time, two control signals will be simultaneously generated on two outputs 42 associated therewith. However, priority circuit 43 responds to the control signal on only the control switch output 42 of highest priority to generate a control signal on its associated output 44.

The control signals developed by priority circuit 43 are applied to, and encoded into binary form by, a binary encoding circuit 46. A different binary code is developed in response to a control signal on each different one of outputs 44. Each code is transferred to a storage circuit 48 and stored therein so long as the corresponding control switch is actuated. The four bits of the code BD, BE, BF and BG are stored in inverted form and are provided to a code selector circuit 50 on outputs $\overline{D}$, $\overline{E}$, $\overline{F}$ and $\overline{G}$.

Figure 3A:
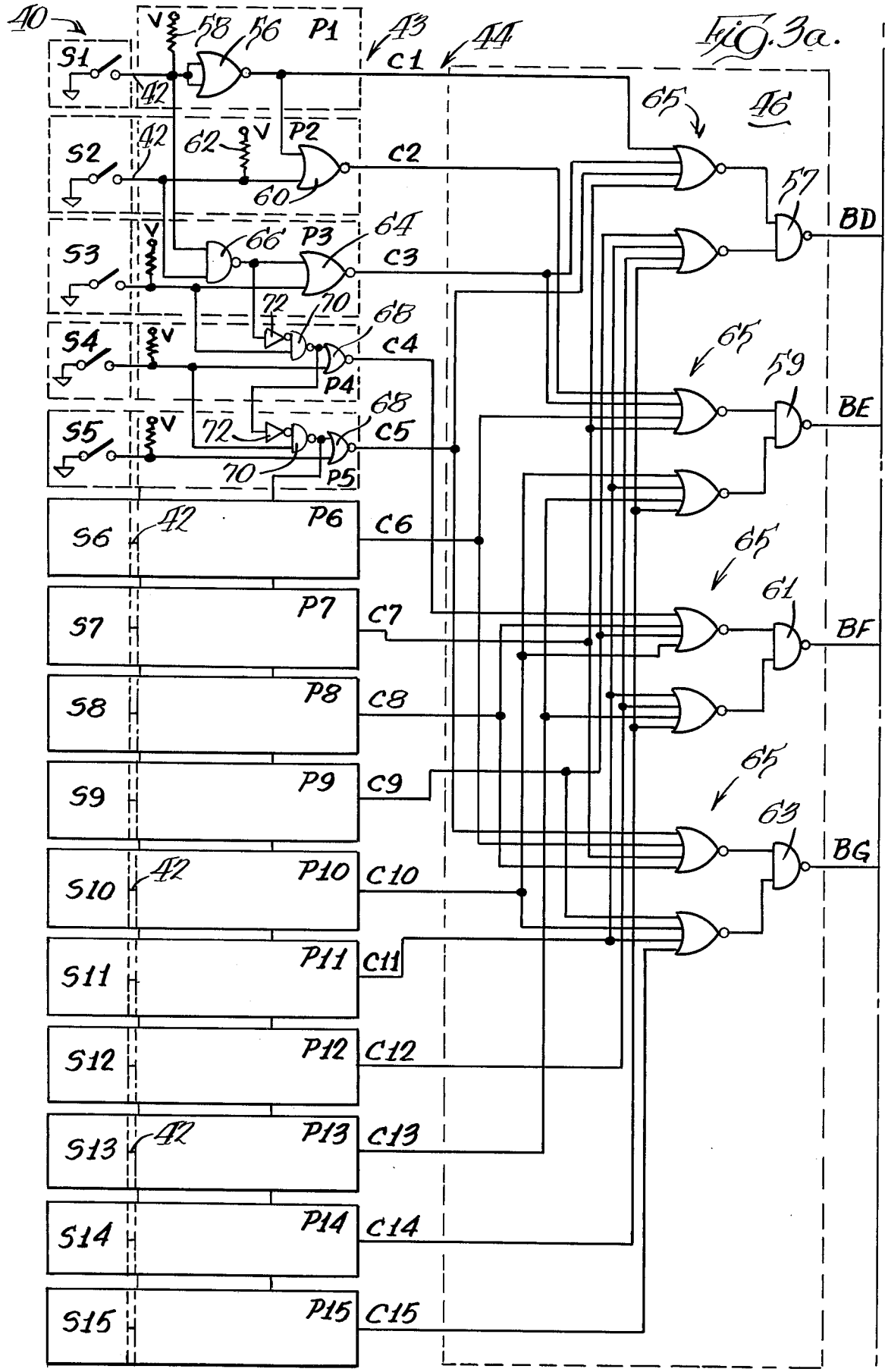
FIGS. 3*a* and 3*b*, when juxtaposed in alignment, form a single continuous line schematic of circuitry corresponding to the functional block diagram of FIG. 2.
Figure 3B:
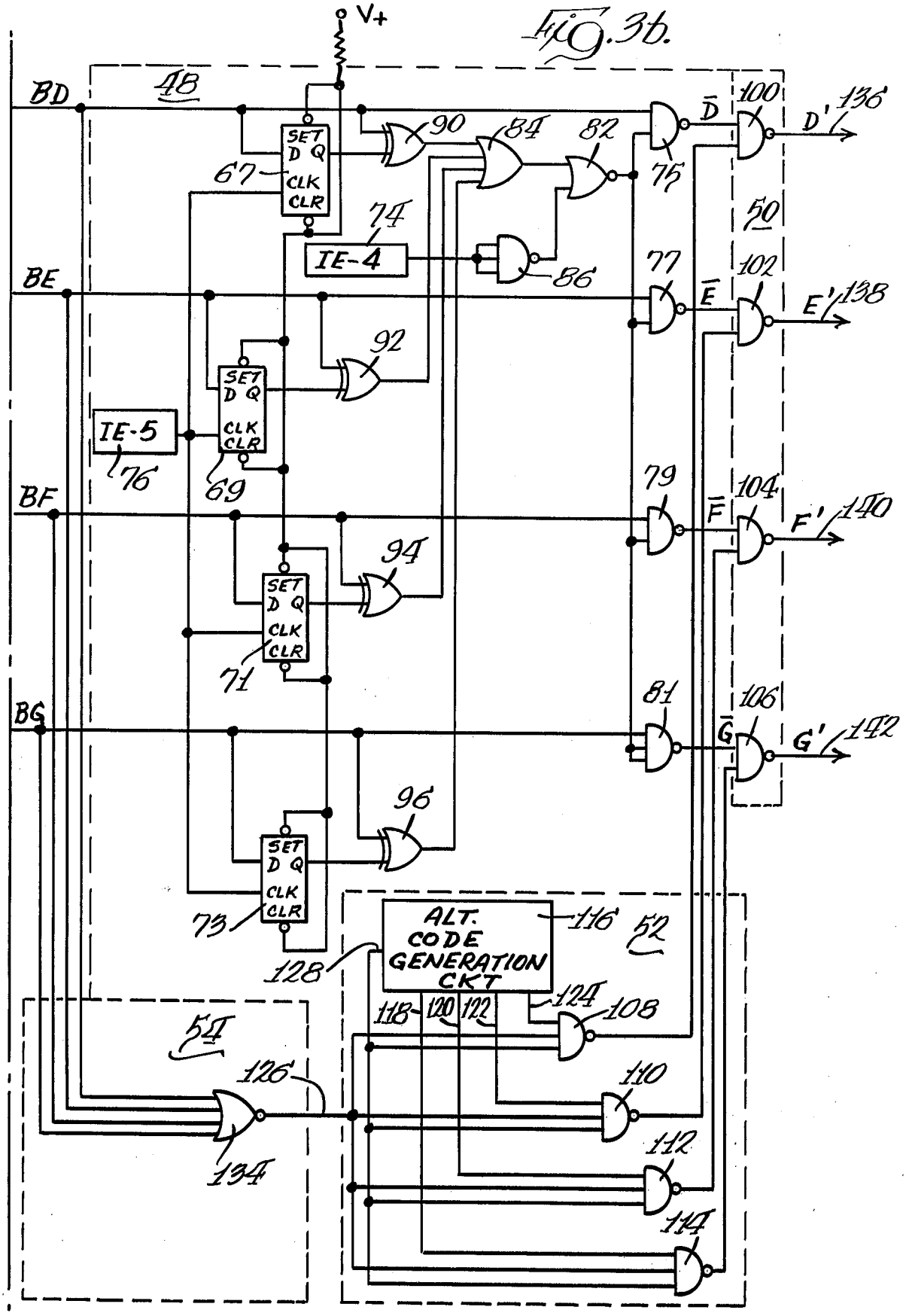

Referring to FIGS. 3*a* and 3*b*, illustrative circuitry corresponding to the functional block of the arpeggio code generator 21 shown in FIG. 2 will be described. Referring first to FIG. 3*a*, the arpeggio control switches 40 are seen to comprise fifteen substantially identical single-throw switches consecutively numbered S1 through S15. One side of each switch is connected to ground and the other side connected to the priority circuit 43 through an associated one of leads 42. The switches are respectively associated with a plurality of keys or other actuatable members (not shown) arranged to facilitate sequential manual actuation of the switches. The switches are biased into an open position and remain closed only so long as manually held in a closed position.

Figure 5:
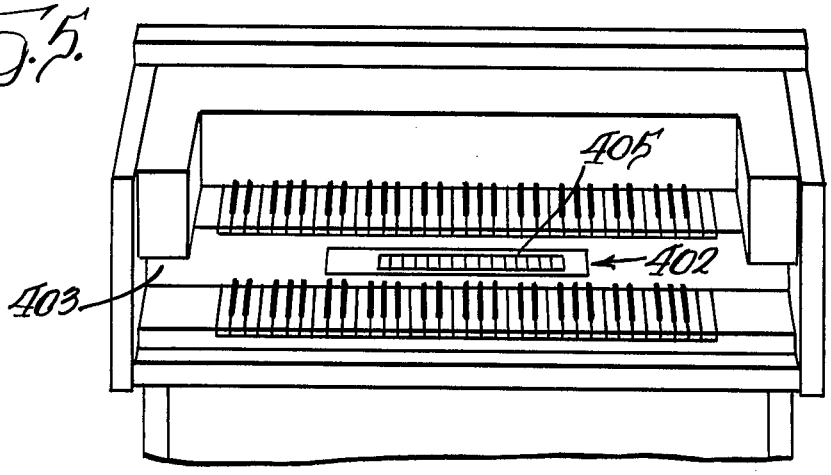
FIG. 5 is a representation of the organ including the digital arpeggio generating device.

Referring to FIG. 5 the switches are actuated by a manual control 402 which is located in a convenient location here shown as the keyslip 403. Thus when a semiautomatic arpeggio is desired the organist would depress one or more keys of the lower manual with his left hand and with his right hand would slide a finger along the fifteen pads 405, thus actuating switches S1–S15. Simultaneously therewith the arpeggio would be sounded.

Returning now to FIG. 3*a* the priority circuit 43 comprises fifteen control signal developing circuits respectively labeled P1 through P15. The circuits P1 through P15 are respectively connected with the fifteen arpeggio control switches S1–S15 to establish a consecutive order of priority therefor with switch S1 having highest priority and switch S15 having lowest priority. Circuits P1 through P15 generate 1-state control signals upon their respective outputs C1 through C15 in response to actuation, i.e., closure of the control switches 40 associated therewith unless a control switch of higher priority is also actuated. For example, closure of switch S1 always results in development of a 1-state control signal on output C1. Closure of switch S5, on the other hand, results in generation of a 1-state control signal on output C5 only if none of the switches S1 through S4 is actuated.

Control signal developing circuit P1 comprises a NOR gate 56 having all inputs connected to the junction between the output side of switch S1 and a resistor 58 connected to a source of positive DC voltage V. When switch S1 is closed, a ground or 0-state signal is applied to all inputs of NOR gate 56 which, in response thereto, provides a 1-state control signal on its output C1. With switch S1 in an open position, the positive voltage V provides a 1-state signal to the inputs of NOR gate 56 and a 0-state signal is developed on output C1.

A priority chain begun with circuit P1 continues with control signal developing circuit P2. Circuit P2 comprises a NOR gate 60 for providing control signals on output C2. One input of NOR gate 60 is connected to switch S2 and through a resistor 62 to voltage source V. The other input is connected to the output C1 of NOR gate 56. With switch S1 in an open or nonactuated position, the control signal on output C1 is in a 0-state. With C1 in a 0-state, NOR gate 60 is enabled to respond to actuation of switch S2 in an identical fashion as NOR gate 56 responds to switch S1. However, with switch S1 closed or actuated, the 1-state signal developed on output C1 disables NOR gate 60. With NOR gate 60 disabled, a 0-state control signal is provided on output C2 regardless of switch S2 actuation. Thus, switch S1 has a greater priority than switch S2.

Circuit P3 includes a NOR gate 64 which provides control signals on its output C3 in response to actuation of switch S3 connected to one of the inputs thereto, except when disabled. The other input to NOR gate 64 is coupled to the output of a NAND gate 66 having a pair of inputs respectively connected to switches S1 and S2. When either of switches S1 or S2 is closed, a 1-state signal is generated on the output of NAND gate 66 to disable NOR gate 64 from responding to actuation of switch S3. Thus, switch S3 is of lower priority than both of switches S1 and S2.

All of the remaining control signal developing circuits are identical, with consecutively numbered circuits being connected in an identical fashion as illustrated by circuits P4 and P5. With this understanding, circuit P6 through P15 are shown only in block form.

Referring to the schematic for circuits P4 and P5 shown in FIG. 3*a*, it is seen that each includes a NOR gate 68 connected with the associated control switch to provide the output control signal in response to actuation thereof. Each of the circuits P4 and P5 also includes a NAND gate 70 having one input connected with the switch of immediately higher priority. Another input of each of NAND gates 70 is connected through an inverter 72 to the output of the NAND gate of the control signal developing circuit of next highest priority. More specifically, the output of NAND gate 70 of circuit P4 is connected through an inverter 72 to an input of the NAND gate 70 of circuit P5.

The output of each NAND gate 70 is connected to an input of the NOR gate 64 of the same circuit. For example, when either of switches S1 through S4 is closed, NOR gate 68 of circuit P5 is disabled from responding to actuation of switch S5. Closure of either switch S1 or S2 provides a 0-state signal to the input of the NAND gate 70 of P4 which results in development of a 1-state signal on the output of NAND gate 70 of P5 to disable NOR gate 68 thereof. Closure of switch S3 likewise causes development of a 1-state signal on the output of NAND gate 70 of circuit P4 with resultant disablement of NOR gate 68. Closure of switch S4 causes a 0-state signal to be applied to the remaining input of NAND gate 70, and thus application of a 1-state disabling signal to the NOR gate 68 of circuit P5.

The NOR gates 68 of the subsequent circuits P6 through P15 are disabled in an identical fashion in response to actuation of any of the switches of higher priority than the switch associated therewith. Thus, it is seen that 1-state control signals are generated on outputs C1 through C5, respectively, in response to actuation of switches S1 through S15, but a 1-state control signal is provided on only one of outputs C1 through C15 at a time.

The fifteen priority circuit outputs 44, C1 through C15, are respectively coupled to fifteen inputs of binary encoding circuit 46 which encodes such control signal into binary form as it is received. Encoding circuit 46 has four outputs BD, BE, BF and BG, on which the four bits D, E, F and G of the binary code developed thereby are respectively provided. The code assigned to each of the control switches can be in one to one correspondence to the identification numbers of the switches i.e. 1 through 15 or can be any code selected on the basis of other criteria.

The function of the binary encoding circuit 46 is performed by a plurality of logic gates in a conventional manner. Binary encoding circuit outputs BD through BG are respectively taken from the outputs of NAND gates 57, 59, 61 and 63. Each of these NAND gates has two inputs for receiving signals from a pair of NOR gates respectively associated therewith designated by reference numeral 65. Each of NOR gates 65 is connected with appropriate ones of priority circuit outputs 44 to provide the correct signal to their associated NAND gates 57–63 necessary for generation of the correct codes. Normally the inputs to NOR gates 65 are 0-state signals, thus causing an output of 1-state signals. When one of the switches is actuated, one of the inputs changes to a 1-state signal causing one of the NOR gates 65 to have a 0-state output signal. This in turn causes one of NAND gates 57–63 to change its normal output of a 0-state signal to a 1-state signal.

Referring to FIG. 3*b*, the binary code bits on outputs BD through BG are respectively stored in four flip-flops 67, 69, 71 and 73 of storage circuit 48. The storage circuit 48 is only necessary when the digital arpeggio circuit is used in the system described in the aforementioned patent applications assigned to the assignee of the present invention. That system requires that a set of 0-state outputs be provided between changes in the binary code and this circuit performs that function. In that system, code signals are transferred through the input circuit 21 from multiple sources including the keyboard 20 and the arpeggio code generator 21 on a multiplexed basis during successive input enable periods established by an input multiplexing circuit. The two input multiplexing periods associated with the present arpeggio circuit are respectively labeled IE-4 and IE-5. The source of these 1-state input enable signals is designated by functional blocks 74 which comprise a clock and multiplex signal generator of conventional design. For a complete description of circuit 74 reference may be made to the above identified co-pending patent applications.

The binary encoding circuit outputs BD through BG are respectively connected to associated inputs of NAND gates 75, 77, 79 and 81. Each of the NAND gates 75–81 has another input connected with the output of a NOR gate 82 and are controlled thereby. When the output of NOR gate 82 is in a 1-state, each of NAND gates 75 through 81 are enabled to respond to 1-state signals applied to their inputs associated with the binary encoding circuit outputs. When NOR gate 82, however, is in a 0-state, all of NAND gates 75 through 81 are disabled, and all provide 1-state signals on their outputs.

NOR gate 82, in turn, is controlled by signals applied to two inputs thereof respectively connected with an OR gate 84 and a NAND gate 86. NAND gate 86 has its input connected with the multiplexing enable output IE-4 of block 74. Whenever IE-4 is in a 1-state, the output of NAND gate 86 is in a 0-state, and the output of NOR gate 82 is dependent upon the signal received from OR gate 84. During all other input multiplexed enable periods, IE-4 is in a 0-state, causing the output of NAND gate 86 to be in a 1-state. A 1-state on NAND gate 86 causes a 0-state on the output of NOR gate 82 which disables all of NAND gates 75–81 from responding to the binary arpeggio encoding output signals. All of NAND gates 75–81 provide 1-state signals on their respective outputs when disabled. Thus, the binary code appearing on the outputs of binary encoding circuit 46 corresponds to the binary code applied to the inputs thereof only during the fourth input enable period.

The clock inputs of each of flip-flops 67–73 are connected with the input multiplex enable generator output IE-5 from functional block 76. The fifth input enable period follows immediately after the fourth input enable period and each of the flip-flops are updated at that time. At the beginning of each fourth input enable period, the normal or Q output of each flip-flop 67–73 may or may not be the same as the state applied to its data input D from the associated binary encoding outputs 49–55 depending upon whether a different control switch has been actuated during the time between successive input enable periods. If the logic states of flip-flops 67–73 respectively correspond to the logic states of outputs 49–55 at the beginning of the fourth input enable period, NAND gates 75–81 are enabled to respond thereto. If not, NAND gates 75–81 are disabled under control of OR gate 84, thereby providing 1-state signals on all outputs $\overline{D}$–$\overline{G}$.

OR gate 84 has four inputs respectively connected to the outputs of exclusive OR gates 90, 92, 94 and 96. Exclusive OR gates 90–96 are respectively associated with flip-flops 67–73 and binary encoding circuit outputs 49–55. Each of exclusive OR gates 90–96 has one input connected with its associated encoding circuit output and one input connected with the Q output of its associated flip-flop. If the two inputs to each of exclusive OR gates 90–96 are the same, each of them provides a 0-state signal to OR gate 84. OR gate 84, in response to 0-state signals at all of its inputs, provides a 0-state signal to NOR gate 82.

During the fourth input enable period when the other input to NOR gate 82 is likewise in a 0-state, NOR gate 82 provides a 1-state enabling signal to each of NAND gates 75–81. However, if any one of the bits of the 4-bit code is changed between successive input enable periods, at least one of the exclusive OR gates 90–96 will have its two inputs in different states and thus provide a 1-state signal to OR gate 84. OR gate 84, in response to any one of its inputs being in a 1-state, provides a 1-state signal to NOR gate 82 which, in response thereto, provides a 0-state disabling signal to all of NAND gates 75–81. As stated, when NAND gates 75–81 are disabled, 1-state signals are provided on all of the outputs thereof. During the immediately succeeding IE-5 period flip-flops 67–73 are reset to the new code and during the next IE-4 period outputs D–G will have this code applied thereto. It should be understood that the multiplexing frequency is very fast, i.e. in the order of 250 Hz which is much faster than the human response time. Consequently the audible output of the organ is not affected by the multiplexing.

The NAND gates 75–81 invert the signals applied thereto from the binary encoding circuit outputs 49–55 so that they appear as D through G on the inputs to NAND gates 100–106. Each of the four NAND gates 100–106 has a pair of inputs, as stated. One of each of the inputs receives the inverted code signal from the associated storage circuit output. The other one of each pair of inputs receives code signals from an alternate code generator 52. Circuit 52 provides code signals for the production of special effects other than arpeggio such as; for instance, glissando, strum, walking bass etc. Circuit 52 does not form a part of the instant invention. For further description thereof reference may be had to the above identified co-pending patent applications. When circuit 52 has not been switched on (switch means not shown) it provides 1-state signals to the inputs of NAND gates 100–106. Instead of using a manual switch to actuate circuit 52 an automatic circuit can be used. Thus preference could be given to the semiautomatic arpeggio circuit so that whenever a control switch S1–S15 is actuated the code appearing on outputs 136–142 represents arpeggio code. By means of NOR gate 134 of circuit 54 the alternate code generator is disabled whenever the arpeggio switches S1–S15 are used. However when the arpeggio circuit is not in use the alternate code generator provides the output code on outputs 136–142. NAND gates 108–114 are enabled by means of line 128. Whenever either the output of NOR gate 134 or 128 is a 0-state signal, NAND gates 108–114 are disabled. At all other times they are enabled to provide an alternate code to gates 100–106.

In the particular embodiment shown whenever any of the control switches S1–S15 are actuated, the code produced on outputs 136–142 is representative of the actuated arpeggio control switch of highest priority.

As stated, the logic states on outputs 136–142 are respectively equivalent to the logic states on outputs BD through BG of binary encoding circuit 46. Thus, it should be appreciated that, in the absence of the need for storage circuit 48 and the alternate code generator 52, outputs 136–142 could be taken directly from outputs BD through BG of binary encoding circuit 46.

Figure 4:
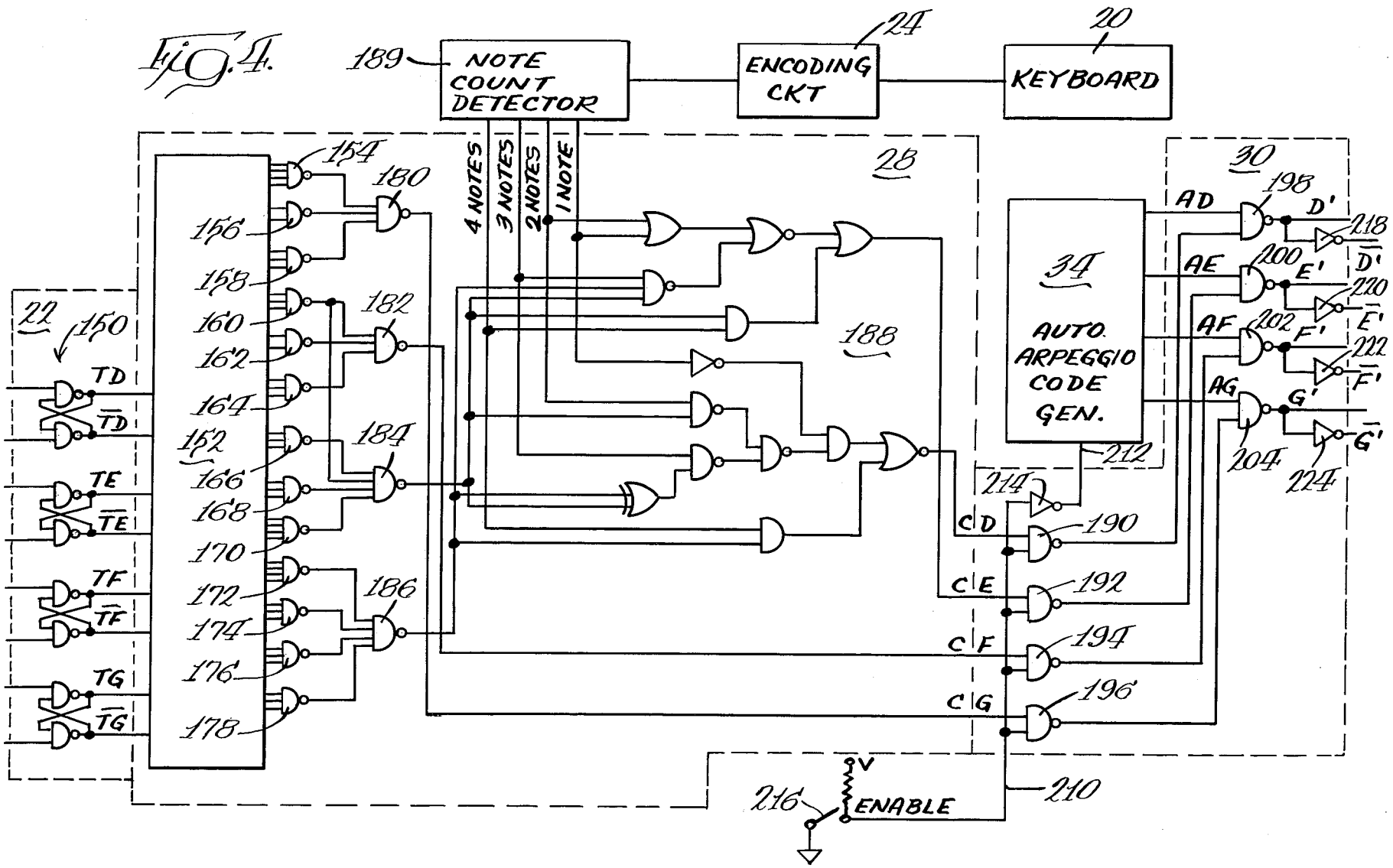
FIG. 4 is a schematic of circuitry corresponding to the code converter block and code select circuit block of FIG. 1.

Turning now to FIG. 4, the circuitry corresponding to the code converter block 28 and the code select circuit 30 of FIG. 1 is shown. In the system of the aforementioned patents assigned to the assignee of the present invention the control signal codes are transferred to an auto function latch circuit including four latches having outputs respectively labeled D, E, F and G. This portion of the auto function latch circuit is schematically represented in FIG. 4 by four latches 150 having outputs respectively labeled TD, TE, TF and TG. Each of the latches also has an inverting output $\overline{TD}$, $\overline{TE}$, $\overline{TF}$ and $\overline{TG}$ carrying the inverse of the binary code bits. The signals on outputs TD–TG are equivalent to the signals on outputs 136–142 of code selector 50. Each of these signals and its inverse is applied to a code bus circuit 152 from which appropriate connections are made to NAND gates 154, 156, 158, 160, 162, 164, 166, 168, 170, 172, 174, 176 and 178 of code converter 28. It should be noted that code converter 28 could be eliminated so that the circuit would only respond to depression of some of control switch S1–S15 as described above.

The connection to the inputs of NAND gates 154–178 is as follows. NAND gate 154 has four inputs respectively connected to $\overline{TD}$, $\overline{TE}$, $\overline{TF}$ and $\overline{TG}$. NAND gate 156 has two inputs respectively connected to TD and TF, and NAND gate 158 has three inputs respectively connected with $\overline{TD}$, TE and TF. NAND gate 160 has three inputs respectively connected to $\overline{TD}$ $\overline{TE}$ and TG. NAND gate 162 has two inputs connected with $\overline{TF}$ and TG, respectively. NAND gate 164 has three inputs respectively connected with TE, TF and $\overline{TG}$. NAND gate 166 has three inputs respectively connected with $\overline{TE}$, TF and $\overline{TG}$. NAND gate 168 has three inputs respectively connected to TD, TE and TG. NAND gate 170 has four inputs respectively connected to TD, TE, $\overline{TF}$ and $\overline{TG}$. NAND gate 172 has four inputs respectively connected to TE, $\overline{TD}$, $\overline{TF}$ and $\overline{TG}$. NAND gate 174 has three inputs respectively connected to TD, TF and $\overline{TG}$. NAND gate 176 has three inputs respectively connected to $\overline{TD}$, $\overline{TE}$ and TF, and finally, NAND gate 178 has three inputs respectively connected to $\overline{TD}$, TE and TG.

The outputs of these NAND gates are variously connected to four further NAND gates 180, 182, 184 and 186, as illustrated in FIG. 4. The connection to the inputs of NAND gate 180 are such that NAND gate 180 decodes binary counts represented by the signals on the outputs of latches 150 of 0, 5, 6, 7, 13, 14 and 15. That is, whenever the signals on the outputs of latches 150 are representative of binary numbers corresponding to these counts, NAND gate 180 develops a 1-state signal on its output. For example, when latch output TD and TF are in a 1-state and outputs TE and TG are in a 0-state, thus representing a binary count of five, a 1-state signal is produced on the output of NAND gate 180. NAND gate 182 likewise decodes binary counts of 6, 7, 8, 9, 10 and 11; NAND gate 184 decodes binary counts of 3, 5, 11, 12 and 15; and NAND gate 186 decodes counts 2, 4, 5, 7, 10, 12 and 14.

Outputs of NAND gates 180 and 182 carry converted code bits CG and CF, respectively corresponding to code bits TG and TF. The outputs of NAND gates 184 and 186 are connected to additional conversion logic circuitry 188 which, in response to the signals thereon develop converted code bits CD and CE respectively corresponding to TD and TE code bits.

Conversion circuitry 188 also receive inputs from a note count detector 189 of the code input and transfer circuit 22. Note count detector 189 receives inputs from the keyboard 20 via encoding circuit 24. Note count detector 189 has four outputs respectively labeled one note, two notes, three notes, and four notes, on which 1-state selected note count signals are respectively produced in response to selection of one note, two notes, three notes and four notes on the keyboard. The details of the note count detector 189 and encoding circuit 24 do not form a part of this invention, and various types of circuits could be employed so long as they perform functionally as described above. One known circuit capable of suitably performing this function is shown in FIG. 6B of my aforementioned co-pending applications. The conversion logic circuit 188 is responsive to both the note count, as indicated by the note count detector outputs, and the output signals from NAND gates 184 and 186 to develop conversion decode bits CD and CE.

The purpose of the code converter 28 is to alter the code when less than four keys are depressed so that in the first mode tones corresponding to depressed keys may be sounded more than once in a particular octave. For instance, if four keys are depressed and we number the tones corresponding thereto *l, m, n, o* and the octaves they are sounded in as suffixes 1, 2, 3 etc., then the arpeggio would progress as $l_1, m_1, n_1, o_1, l_2, m_2, n_2, o_2, l_3, m_3$, etc. However, if only three keys *l, m, n* were depressed and code converter were operating the arpeggio would progress as $l_1, m_1, m_1, n_1, l_2, m_2, m_2, n_2, l_3, m_3$, etc. If only two keys *l* and *m* were depressed it would be $l_1, l_1, m_1, m_1, l_2, l_2, m_2, m_2, l_3, l_3$, etc. Of course it should be noted that repetition of other tones could be used depending on designer preference. To cause the circuit to play these sequences the codes must be converted based on the number of notes depressed so that the output circuit will play the proper note in response to depression of the arpeggio switches.

The conversion performed by code converter 28 between the input code on code transfer circuit output TD, TE, TF and TG, and the code produced on code converter outputs CD, CE, CF and CG can be readily determined from the circuit shown by one skilled in the art. By tracing the logic of FIG. 4 a code conversion chart for the illustrated embodiment can be established. Different output codes result for the same input codes depending upon the number of keys which are depressed. For example, with switch S4 closed, developing a transfer output code having a binary count of four, a binary count of four is produced on the converter code outputs when four keys are down, but a binary count of three is produced when three keys are down. Likewise, when two keys are down, a binary count of two is produced, and when only one key is down, only a binary count of one is developed on outputs CD, CE, CF and CG.

In some instances, the converted code count for the same control signal remains the same for detection of different numbers of keys. For instance, with switch S1 closed, a binary count of one is produced when four notes are selected and also when three notes are selected. It can also be noted that for a given number of selected notes, the converter sometimes produces the same converted code for different input codes. For example, with two selected notes or two keys down, binary counts of one are produced both when switch S2 is closed and when switch S3 is closed. A conversion code is developed in response to closure of each and every switch. A count of zero is developed regardless of the number of keys down, when none of the switches are closed.

Turning now to FIG. 4, the code converter outputs CD, CE, CF and CG are respectively applied to associated inputs of four NAND gates 190, 192, 194 and 196 of code select circuit 30. Code select circuit 30 also has four NAND gates 198, 200, 202 and 204 for respectively receiving code bits on outputs AD, AE, AF and AG of auto arpeggio code generator 34. The auto arpeggio code generator functions to generate codes in the manner specified above in connection with the description of FIG. 1. NAND gates 198–204 also have inputs respectively connected to the outputs of NAND gates 190 and 196 and thereby receive the inverse of the control switch codes on outputs CD–CG. A 4-bit code D′–G′ is produced on the outputs of NAND gate 198–204 respectively.

The output codes developed on D′–G′ correspond to the codes generated from auto arpeggio code generator 34 or the converted codes from code converter 28, depending upon the state of the signal produced on an enable line 210. Enable line 210 is connected to an input of each of NAND gates 190–196 and to a control input 212 of auto arpeggio code generator 34 through an inverter 214. The state of the signal produced on enable line 210 may be controlled by a variety of means, but for purposes of brevity, it is simply illustrated by means of a single pole switch 216 having one side connected to ground and the other side connected to the source of positive voltage V through a suitable resistor.

With switch 216 in an open position as shown, a 1-state signal is provided to each of the NAND gates 190–196 which are enabled thereby to develop output signals responsive to their inputs from the code converter 28. This 1-state signal inverted by inverter 214 and applied to input 212 disables auto arpeggio code generator 34 which, when disabled, provides 1-state signals on all of its outputs AD–AG. Thus, with switch 216 in an enable position, NAND gates 198–204 develop codes on outputs D′–G′, respectively equivalent to the converter codes on outputs CD–CG. With switch 216 closed, however, all of NAND gates 190–196 are disabled, all providing 1-state signals to NAND gates 198–204 and the auto arpeggio code generator is enabled to generate code signals on outputs AD–AG. The codes produced on outputs D′–G′ then respectively correspond to the codes on AD–AG. The inverse of each of the codes developed on D′–G′ are respectively provided by four inverters 218, 220, 222 and 224.

Figure 6:
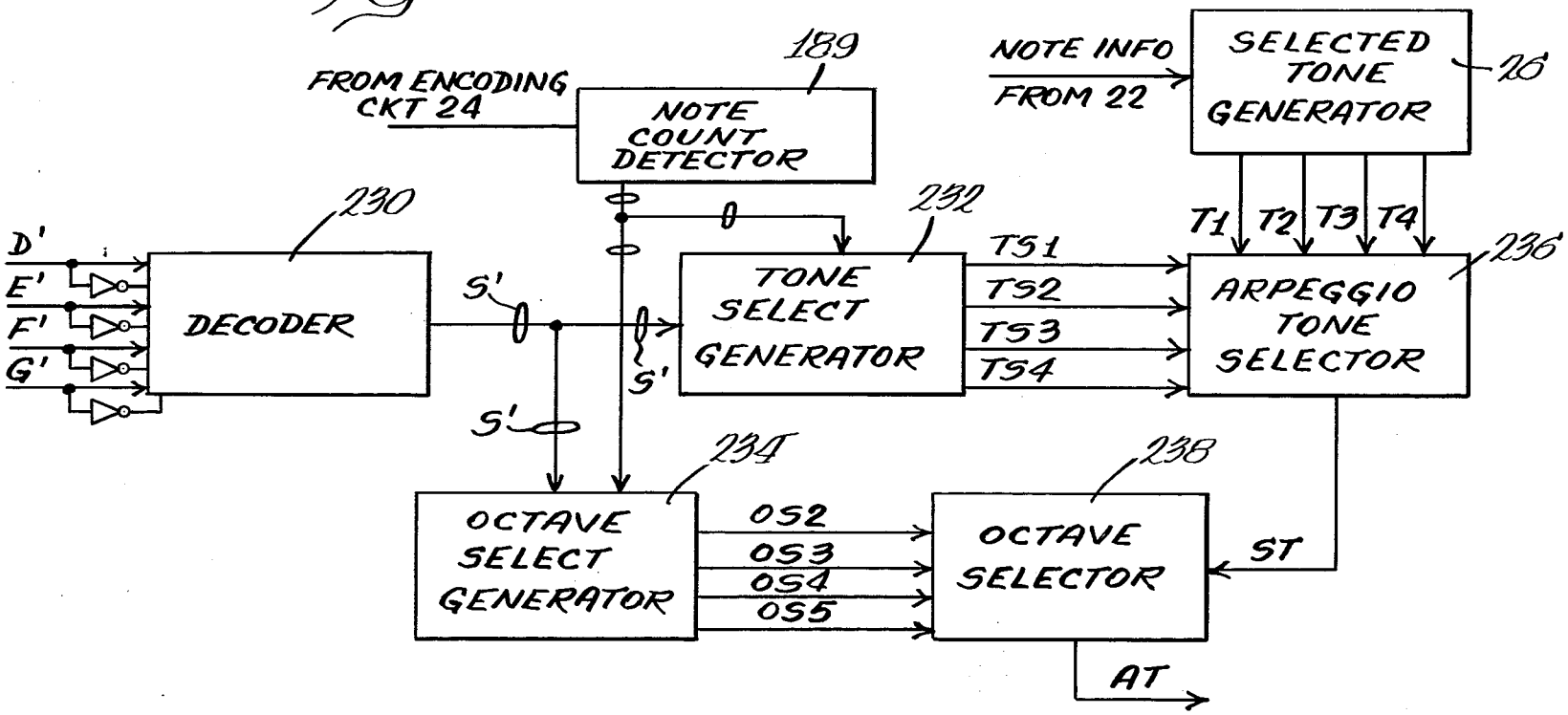
FIG. 6 is a detailed functional block diagram corresponding to the arpeggio gating block of FIG. 1.

Referring to FIG. 6, the arpeggio gating circuit 32 is seen to include a decoder 230 which receives the D′–G′ outputs from code select circuit 32. Decoder 230 develops decode control signals on a plurality of output lines collectively designated by S′ associated with the sixteen possible code combinations of the 4-bit code.

The decode control signals are connected to a tone select generator 232 and an octave select generator 234. Both the tone select generator 232 and the octave select generator 234 also receive the selected note count information on the outputs from note count detector 189. Tone select generator 232 in response to both the note count and the decode control signal being applied thereto generates a tone select signal on a selected one of four outputs thereof TS1, TS2, TS3 and TS4. Octave select generator 234, in response to both the indicated note count and the decode control signal, generates an octave select signal on a selected one of four outputs thereof OS2, OS3, OS4 and OS5.

The tone select generator outputs TS1–TS4 are connected to an arpeggio tone selector 236. Arpeggio tone selector 236 also receives the four selected tone signals on outputs T1–T4 of the selected tone generator 26, and selectively provides one of these tone signals on output ST respectively in response to receipt of a tone signal on an associated one of tone select generator outputs TS1–TS4. The note information to select tone generator 26 can be either from a memory circuit or from contemporaneous playing of the keys. This is further described in my co-pending above identified patent applications. When a tone select signal is provided on TS1, the selected tone signal is that provided on output T1. Likewise, the tone signals on outputs T2–T4 are selected respectively in response to tone select signals on TS2–TS4. Thus the signals on T1–T4 represent the tone signals which have been selected by the operator on the lower manual and the signals on TS1–TS4 represent the order in which they are to be played which depends on the switch S1–S15 which is then being activated.

The selected tone signal on ST is applied to octave selector 238, which is also connected with the octave select generator through outputs OS2–OS5. The octave selector 238 generates a tone signal on its output AT having one of four different frequency relationships with the selected tone signal depending upon the outputs OS2–OS5 of the octave select generator. With an octave select signal appearing on outputs OS2, the frequency of the output tone signal is $\frac{1}{4}$ that of the selected tone signal. With octave select signals on outputs OS-3–OS5, the output tone signal is provided at frequencies equal to $\frac{1}{8}$, 1/16 and 1/32 of the selected tone signals, respectively.

Figure 7:
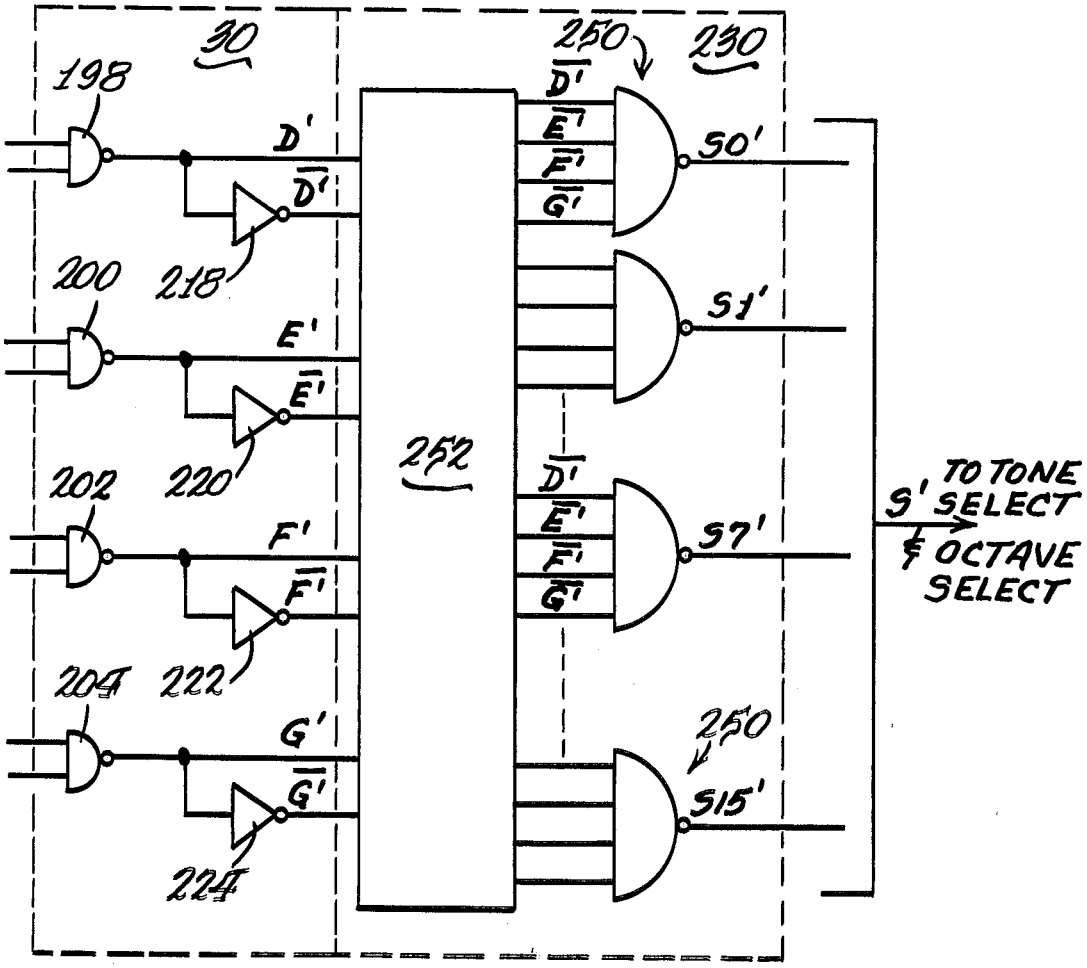
FIG. 7 is a schematic of circuitry corresponding to the decoder block of FIG. 6.

Referring to FIG. 7, the decoder 230 is seen to comprise sixteen NAND gates 250 each having four inputs connected to various ones of code select outputs D′–G′ and $\overline{D}'$–$\overline{G}'$ through a code bus 252. The sixteen NAND gates 250 respectively produce 0-state decode control signals on their associated outputs S0′–S15′ in response to binary counts of zero through fifteen. For example, the NAND gate 250 having output S0′ has inputs connected with $\overline{D}'$, $\overline{E}'$, $\overline{F}'$ and $\overline{G}'$. When none of the control switches are actuated, all of these inputs are in a 1-state, and a 1-state signal is produced on output S0′. Likewise, for example, the NAND gate 250 with output S7 has four inputs respectively connected with D′, E′, F′ and $\overline{G}'$. When switch S7 is closed or automatic arpeggio code generator 34 generates a count of seven, all of these inputs are in a 1-state, and a 0-state signal is generated on output S7′.

Figure 8A:
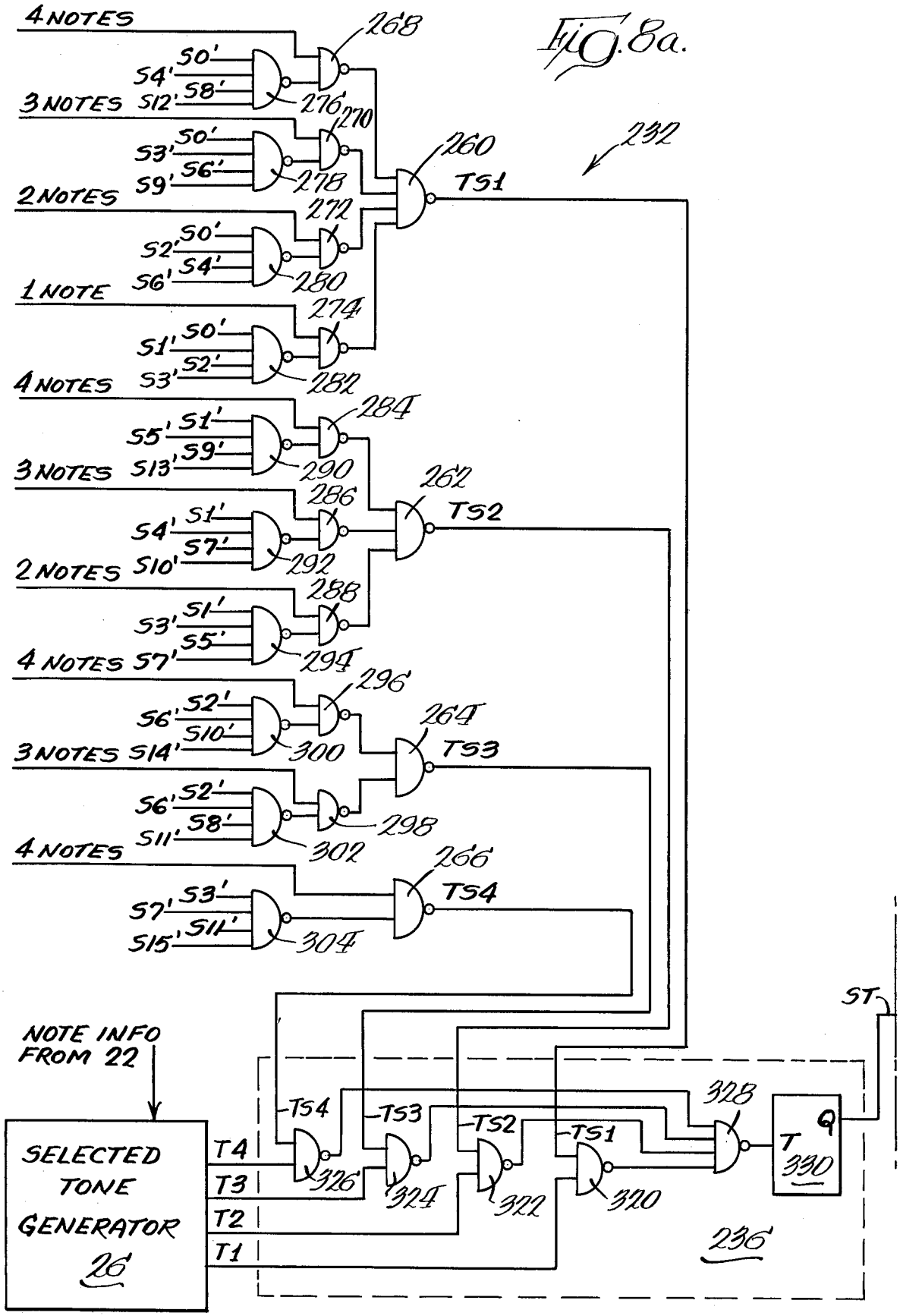
FIGS. 8*a* and 8*b*, when juxtaposed in alignment, form a continuous line schematic of the circuitry corresponding to the tone select generator and octave select generator blocks of FIG. 6.

The circuitry corresponding to the tone select generator 232 and arpeggio tone selector 236 which is illustrated in functional block form in FIG. 6, is illustrated in detail in FIG. 8*a*. As seen, the tone selector outputs TS1–TS4 are taken from the outputs of four NAND gates 260, 262, 264 and 266, respectively. NAND gate 260 has four inputs respectively connected to the output of four NAND gates 268, 270, 272 and 274. These NAND gates have inputs respectively connected with the four notes, three notes, two notes and one note outputs of note count detector 189. These four NAND gates also receive signals from the outputs of four NAND gates 276, 278, 280 and 282, each of which has four inputs respectively connected to various ones of the decoder output S0–S15, as indicated in FIG. 8*a*. NAND gate 262 is similarly connected with three NAND gates 284, 286 and 288 which respectively receive inputs from the four notes, three notes, two notes outputs of the note count detector 189 and from three NAND gates 290, 292 and 294 connected with the indicated outputs of decoder 230. NAND gate 264 is likewise responsive to the appropriate ones of the decoder outputs and the note count detector through the action of NAND gates 296 and 298 and NAND gates 300 and 302 respectively connected therewith. Finally, NAND gate 266 has one input connected with the four notes output and another input taken from the output of a NAND gate 304.

Figure 8B:
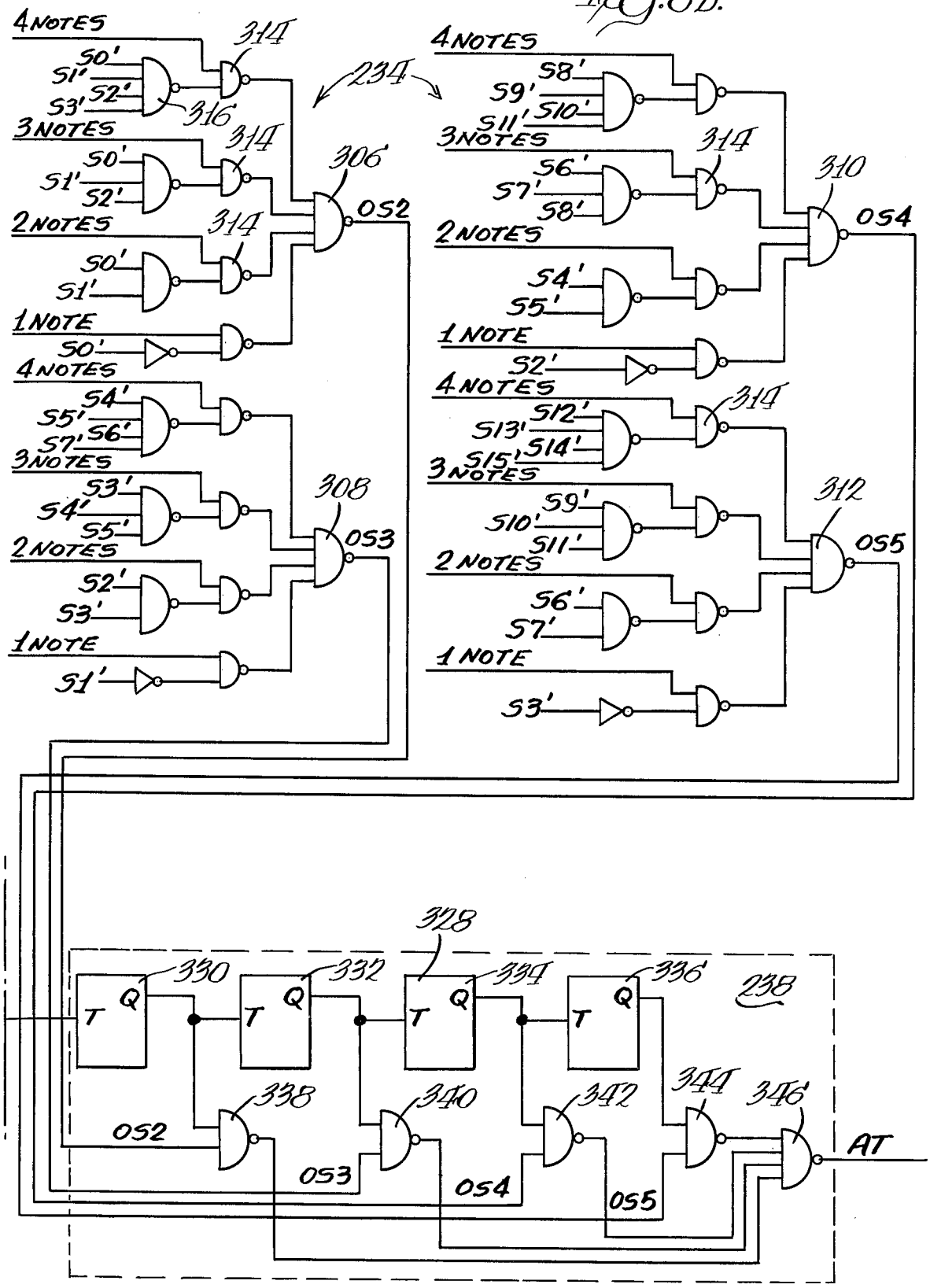

Referring particularly to FIG. 8*b*, the octave select generator 234 functions in a fashion substantially identical to that of the tone select generator 232. As can be seen, the four octave select generator outputs OS2, OS3, OS4 and OS5 are taken from the outputs of four NAND gates 306, 308, 310 and 312. Each of the four NAND gates 306–312 has four inputs from four NAND gates 314. Each of NAND gates 314 receives one input from one of the note code detector outputs and one input from a NAND gate 316 associated therewith which receives inputs from appropriate ones of the decoder outputs S0′–S15′. The connections to the inputs of NAND gate 316 are as indicated in FIG. 8*b*, and the octave select generator generates the octave select signals on selected ones of its outputs.

The tone selector 236 selects the appropriate tone signal from selected tone generator 26 through control of four NAND gates 320, 322, 324 and 326, respectively connected with outputs T1–T4. NAND gates 320–326 also have inputs respectively connected with outputs TS1–TS4, respectively. Each of these NAND gates applies the tone signal connected therewith to its output in response to its tone select input switching to a 1-state. The four NAND gate outputs are respectively connected to four inputs of a NAND gate 328, the output of which is connected to a toggle flip-flop 330. Toggle flip-flop 330 in response thereto generates the selected tone signal on its normal or Q output ST at half the frequency of the selected tone signal applied thereto.

Referring particularly to FIG. 8*b*, it is seen that the selected tone signal on output ST is applied to the toggle input of the first stage flip-flop 330 of a four-stage frequency divider 328. Frequency divider 328 comprises four toggle flip-flops 330, 332, 334 and 336 connected in cascade with the toggle inputs of each flip-flop receiving signal from the Q output of the immediately previous flip-flop in the sequence. Thus, a plurality of tone signals having different predetermined frequency relationships with the selected tone signals are provided simultaneously on the four Q outputs of flip-flops 330–336. The normal outputs thereof are respectively connected to inputs of four NAND gates 338, 340, 342 and 344.

NAND gates 338–344 also have inputs respectively connected with octave select generator outputs OS-2–OS5. Accordingly, the plurality of different frequency related tone signals from frequency divider 328 are selectively developed on the outputs of the NAND gates 338–344 in accordance with the octave select signals applied thereto. For example, when a 1-state octave select signal is provided on output OS2, NAND gate 338 generates a tone signal at the same frequency of the tone signal provided from flip-flop 330. NAND gates 340–342 likewise respectively respond to octave select signals on outputs OS3–OS5 to generate signals from flip-flops 332–336, respectively. The outputs from all of NAND gates 338–344 are applied to respective inputs of a NAND gate 346 which develops the arpeggio or output tone signal on its output AT.

The codes generated on outputs D′, E′, F′ and G′ in response to actuation of the manual control switches S1–S15 are equivalent to the codes developed on outputs CD, CE, CF and CG. With these codes being generated, the relationship between switch actuation and the outputs of the octave select generator 234 and the tone select generator 232 is illustrated in the input-output chart of FIG. 9. As seen in FIG. 9, a tone signal will be generated in response to actuation of each and every switch even when less than four keys are held down on the keyboard.

With the code converter in operation, some tones are repeated as shown in FIG. 9. Therefore codes D′–G′ are simulated upon depression of a switch to which a repeat tone has been assigned. This is accomplished by the code converter as described above. For example, with a note count of one, the code for switch S3 is simulated in response to closure of switch S15. Here, again, the time limitation between successive tone signals of the sequence is uniform when the manual control switches 40 are scanned at a uniform rate. A further feature is that a tone signal is generated in response to activation of each and every manual control switch 40. Thus by way of example, with two keys depressed the arpeggio would progress as shown in FIG. 9 in the column labeled two keys.

Having described the invention, the embodiments of the invention in which an exclusive property or privilege is claimed are defined as follows:

1. In a musical instrument having tone signal generating means, a first set of controls for selecting tone signals and means for sequentially producing tone signals having predetermined frequency relationships with the selected tone signals, the improvement comprising:

a second set of serially arranged individually actuable switches smaller in number than said first set of controls and manually actuable for generating a series of individually identifiable control signals; means associated with said second set of switches for preventing generation of more than one control signal at a time;

means connected with said second set of switches and said tone signal generating means for associating a selected tone signal with each of said control signals; and means responsive to generation of each control signal and its associated selected tone signal for generating output tone signals having predetermined frequency relationships with said selected tone signals.

2. The musical instrument of claim 1 including means connected with each of said switches for developing a control signal in response to actuation of its associated switch, a priority circuit connected to said switches for passing the highest priority control signal developed by said switches in accordance with a predetermined order of priority, and means responsive to said highest priority control signal for disabling the developing means associated with the switches of lower priority than said one switch.

3. In a musical instrument having tone signal generating means, a first set of controls for selecting tone signals and means for sequentially producing tone signals having predetermined frequency relationships with the selected tone signals, the improvement comprising:

a second set of serially arranged individually actuable switches smaller in number than said first set of controls and manually actuable for generating a series of individually identifiable control signals;

means for binarily encoding the control signals from the second set of switches, means connected with said second set of switches and said tone signal generating means for associating a selected tone signal with each of said control signals;

means responsive to generation of each control signal and its associated selected tone signal for generating output tone signals having predetermined frequency relationships with said selected tone signals;

said associating means includes means for associating each of said selected tone signals with at least one of the coded control signals, and said output tone signal generating means includes means responsive to each coded control signal for selecting the predetermined frequency relationship between the tone signal associated therewith and the output tone signal.

4. The musical instrument of claim 3 including an alternate source of coded control signals, said alternate source of control signals providing alternate code signals independently of said binarily encoding means, and means responsive to actuation of said manually actuable switches for disabling the alternate source.

5. In a musical instrument having keyboard means for manually selecting notes from a plurality of selectable notes, means for generating tone signals corresponding to the selected notes, a plurality of sequentially manually actuatable control switches and means for sequentially generating output tone signals corresponding to the selected notes, comprising:

means connected to said control switches for generating a plurality of control signals in response to actuation thereof;

means connected to the keyboard for detecting the number of selected notes; and means connected to the tone signal generating means and responsive to the note detection means and the control signals for sequentially producing output tone signals having predetermined frequency relationships with the selected notes.

6. The musical instrument of claim 5 in which said output tone signal generating means includes means for selecting one of the generated tone signals in accordance with a control signal and the detected number of selected notes, and means for selectively generating an output tone signal at a frequency related to that of the selected generated tone signal in accordance with the control signal and the detected number of selected notes.

7. The musical instrument of claim 6 in which the predetermined frequency of the output tone signal is octavely related to that of the selected generated tone signal.

8. The musical instrument of claim 6 wherein said output tone signal generating means includes means for simultaneously generating a plurality of signals having different predetermined frequency relationships with the frequency of the selected tone signal, and means responsive to the detected number of selected notes and the control signal corresponding to a selected generated tone signal for providing one of said different frequency-related signals at an output thereof.

9. The musical instrument of claim 8 in which said different frequency-related signals are substantially octavely related to the frequency of the selected tone signal.

10. The musical instrument of claim 8 in which said tone signal selecting means includes means responsive to different control signals for selecting the same generated tone signal.

11. The musical instrument of claim 8 in which said tone signal selecting means includes means for selecting different frequency relationships between the output tone signal and the selected tone signal.

12. The musical instrument of claim 8 in which said tone selecting means includes means responsive to detection of different numbers of notes for selecting different tone signals in response to the same control signal.

13. The musical instrument of claim 6 including means connected between the control signal generating means and the tone selection means for altering the control signal provided to said tone selection means to simulate actuation of control switches which are not being actuated in response to actuation of other control switches.

14. The musical instrument of claim 13 including means for automatically generating said control signals and means for selectively providing the control signals to the tone selection means from one of the manual control signal generating means and the automatic control signal generating means.

15. In an electrical musical instrument, a circuit for generating a sequence of tone signals corresponding to selected notes, comprising:

means manually actuatable for generating a plurality of manual tone selection codes;

means for automatically generating a plurality of automatic tone selection codes;

means for decoding codes provided thereto;

means responsive to the decoding means for selectively generating tone signals in accordance therewith; and means for selectively providing codes from one of the manual code generating means and the automatic code generating means to the decoding means whereby tone signals are generated selectively in response to the manual code and the automatic codes.

16. The electrical musical instrument of claim 15 in which said manual code generating means includes a plurality of sequentially manually actuatable control switches, means for generating an ordered sequence of codes in response to sequential actuation of the control switches, and means for converting the manual codes before they are applied to the decoder whereby some of the tone signals are repeated in said sequence.

17. The electrical musical instrument of claim 15 in which said selectively providing means includes means for manually enabling the application of codes from either said manual code generating means or said automatic code generating means to the decoding means, and means responsive to enablement one of said code generating means for disabling the other of the code generating means from generating its codes.

18. In an electronic musical instrument;

a set of keys operably connected to a first set of electrical switches;

tone generator means connected to the first set of electrical switches to generate tone signals in response to actuation of said switches;

a set of controls for operating a second set of electrical switches;

encoding means connected to the second set of switches for generating encoded signals representative of the actuated switches;

gating means connected to said tone generator means and to said encoding means for selectively gating said tone signals in response to said encoded signals; and electromechanical transducing means connected to said gating means for converting said tone signals to sound, whereby an arpeggio effect is generated by simultaneous operation of said keys and said set of controls.

19. The electronic musical instrument of claim 18 wherein said gating means comprises:

a first set of gates for selectively gating the generated tone signals;

frequency dividing means connected to said first set of gates for developing tone signals which are octavely related to said selectively gated tone signals; and a second set of gates connected to said frequency dividing means and said encoding means for selectively gating said octavely related tone signals.

20. The electronic musical instrument of claim 18 wherein the first set of keys is numerically greater than the set of controls.

* * * * *